US010131858B2

(12) United States Patent
Sakai et al.

(10) Patent No.: US 10,131,858 B2
(45) Date of Patent: Nov. 20, 2018

(54) METHOD FOR MANUFACTURING ASHLESS COAL

(71) Applicant: Kobe Steel, Ltd., Kobe-shi (JP)

(72) Inventors: Koji Sakai, Hyogo (JP); Noriyuki Okuyama, Hyogo (JP); Takuya Yoshida, Hyogo (JP); Shigeru Kinoshita, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 15/505,807

(22) PCT Filed: Sep. 17, 2015

(86) PCT No.: PCT/JP2015/076497
§ 371 (c)(1),
(2) Date: Feb. 22, 2017

(87) PCT Pub. No.: WO2016/052230
PCT Pub. Date: Apr. 7, 2016

(65) Prior Publication Data

US 2017/0275547 A1 Sep. 28, 2017

(30) Foreign Application Priority Data

Sep. 30, 2014 (JP) ..... 2014-202092

(51) Int. Cl.
*C10L 5/00* (2006.01)
*C10L 5/04* (2006.01)
*C10L 9/00* (2006.01)

(52) U.S. Cl.
CPC ..... *C10L 5/04* (2013.01); *C10L 9/00* (2013.01); *C10L 2290/06* (2013.01);
(Continued)

(58) Field of Classification Search
CPC ..... C10L 5/00; C10L 5/04; C10L 9/00
(Continued)

(56) References Cited

U.S. PATENT DOCUMENTS 4,030,982 A * 6/1977 Gorin ..... C10B 53/08 201/22
4,039,424 A * 8/1977 Hyde ..... C10G 1/002 201/28
(Continued)

FOREIGN PATENT DOCUMENTS

JP 55-127485 A 10/1980
JP 2005-120185 A 5/2005
(Continued)

OTHER PUBLICATIONS

International Search Report and Written Opinion dated Oct. 27, 2015 in PCT/JP2015/076497 (with English translation).

*Primary Examiner* — Ellen M McAvoy
(74) *Attorney, Agent, or Firm* — Oblon, McClelland, Maier & Neustadt, L.L.P.

(57) ABSTRACT

The present invention is provided with a step for preheating coal, a step for heating an extraction solvent, a step for mixing the preheated coal and the extraction solvent heated to a higher temperature than the preheated coal and thereby heating the coal, a step for separating a solution in which a coal component is dissolved from the mixture of the coal and the extraction solvent, and a step for evaporating and separating the extraction solvent from the solution.

20 Claims, 6 Drawing Sheets

(52) U.S. Cl.
CPC ..... *C10L 2290/24* (2013.01); *C10L 2290/46* (2013.01); *C10L 2290/544* (2013.01)

(58) Field of Classification Search
USPC ..... 44/620–627
See application file for complete search history.

(56) References Cited

U.S. PATENT DOCUMENTS

| | | | | |
|---|---|---|---|---|
| 4,039,426 | A * | 8/1977 | Schutte | C10G 1/002 201/20 |
| 9,321,028 | B2 * | 4/2016 | Vimal | C10L 9/02 |
| 9,334,456 | B2 * | 5/2016 | Sakai | C10L 5/04 |
| 9,334,457 | B2 * | 5/2016 | Sakai | C10L 9/00 |
| 9,382,493 | B2 * | 7/2016 | Sakai | C10L 5/04 |
| 9,441,175 | B2 * | 9/2016 | Chandaliya | C10L 9/02 |
| 9,714,394 | B2 * | 7/2017 | Kinoshita | C10L 1/322 |
| 2014/0311024 | A1 | 10/2014 | Sakai et al. | |
| 2015/0013215 | A1 * | 1/2015 | Sakai | C10L 1/326 44/627 |
| 2015/0376528 | A1 * | 12/2015 | Sakai | C10L 9/02 44/627 |
| 2016/0002551 | A1 | 1/2016 | Okuyama et al. | |
| 2016/0060558 | A1 * | 3/2016 | Yoshida | C10L 5/04 44/627 |

FOREIGN PATENT DOCUMENTS

| | | | |
|---|---|---|---|
| JP | 2009-227718 | A | 10/2009 |
| WO | WO 2014/157409 | A1 | 10/2014 |

* cited by examiner

METHOD FOR MANUFACTURING ASHLESS COAL

TECHNICAL FIELD

The present invention relates to a process for producing an ash-free coal.

BACKGROUND ART

Coals are extensively utilized as fuels for thermal electric-power generation or boilers or as starting materials for chemical products, and there is a strong desire to develop a technique for efficiently removing the ash matter contained in coals, as a measure for environmental preservation. For example, in a high-efficiency combined electric-power generation system based on gas turbine combustion, an attempt is being made to use an ash-free coal (HPC) from which ash matter has been removed, as a fuel that replaces liquid fuels including LNG. It is also attempted to use an ash-free coal as a feed coal for steelmaking cokes, such as cokes for blast furnaces.

Proposed as a process for producing an ash-free coal is a process in which a solution containing coal components soluble in solvents (hereinafter referred to as "solvent-soluble components") is separated from a slurry by using a gravitational settling method (for example, JP-A-2009-227718). This process includes a slurry preparation step in which a coal is mixed with a solvent to prepare a slurry and an extraction step in which the slurry obtained in the slurry preparation step is heated to extract solvent-soluble components. This process further includes: a solution separation step in which a solution containing the solvent-soluble components dissolved therein is separated from the slurry in which the solvent-soluble components have been extracted in the extraction step; and an ash-free-coal acquisition step in which the solvent is separated from the solution separated in the solution separation step, thereby obtaining an ash-free coal.

In the extraction step of a conventional process for ash-free-coal production, the slurry obtained in the slurry preparation step is heated to a given temperature and supplied to an extraction tank. The slurry supplied to the extraction tank is held at a given temperature while being stirred with a stirrer, thereby extracting solvent-soluble components. In this extraction step, the slurry is allowed to stay in the extraction tank for about 10-60 minutes in order to sufficiently dissolve the solvent-soluble components in the solvent.

Since the time period required for extracting the solvent-soluble components in the extraction step considerably affects the time period required for ash-free-coal production, there has conventionally been a request for shortening the extraction period. If the time period required for heating the slurry to the given temperature can be shortened the extraction period in the extraction step can be shortened. It is hence possible to shorten the extraction period by rapidly elevating the temperature of the slurry to the given temperature in the extraction step.

It seems that as a method for rapidly elevating the temperature of the slurry to the given temperature, use can be made, for example, of a method in which in the slurry preparation step, a coal is mixed with a preheated solvent so that the slurry to be introduced into the extraction step has a temperature elevated beforehand. However, the higher the temperature of the solvent to be mixed with the coal, the higher the apparatus design pressure and the higher the equipment cost and operating cost. It is hence difficult to rapidly elevate the temperature of the slurry at low cost.

PRIOR ART DOCUMENT

Patent Document

Patent Document 1: JP-A-2009-227718

SUMMARY OF THE INVENTION

Problem that the Invention is to Solve

The present invention has been achieved under the circumstances described above, and an object thereof is to provide a process for producing an ash-free coal, the process being capable of shortening, at low cost, the period for extracting solvent-soluble components.

Means for Solving the Problem

The invention, which has been achieved m order to overcome the problem described above, is a process for producing an ash-free coal, the process including a step of preheating a coal, a step of heating an extraction solvent, a step of mixing the coal after the preheating with the extraction solvent which has been heated to a temperature higher than that of the coal, thereby heating the coal, a step of separating a solution containing a coal component dissolved therein from the mixture of the coal and the extraction solvent, and a step of separating the extraction solvent from the solution by a vaporization.

In this process for producing an ash-free coal, the temperature of a mixture of a coal and an extraction solvent can be rapidly elevated while reducing the amount of energy necessary for elevating the temperature of the mixture, because of the step of preheating the coal to be mixed with the extraction solvent. Thus, not only the cost of heating the mixture can be reduced, but also the temperature of the mixture is rapidly elevated to a temperature at which the solvent-soluble components are readily extractable, thereby speedily extracting the solvent-soluble components. As a result, the time period for extracting solvent-soluble components can be shortened at low cost by this process for producing an ash-free coal.

It is preferable that the preheating step should include a step of mixing a solvent for preheating with the coal and a step of heating a preliminary mixture of the coal and the solvent for preheating. By thus mixing a solvent for preheating with the coal to obtain a preliminary mixture and heating the preliminary mixture in the preheating step, the efficiency of elevating the coal temperature during the mixing with an extraction solvent in the coal heating step is further improved. In addition, the handling of the preliminary mixture of a coal and a solvent for preheating, rather than the handling of a coal alone, brings about improved handleability.

It is preferable that the preheating step should include a step of heating a solvent for preheating and a step of mixing the heated solvent for preheating with the coal. By thus mixing the heated solvent for preheating with the coal in the preheating step, the coal gives a preheated preliminary mixture with the solvent for heating and, hence, the efficiency of elevating the coal temperature during the mixing with an extraction solvent in the coal heating step is further improved. In addition, the handling of the preliminary mixture of a coal and a solvent for preheating, rather than the handling of a coal alone, brings about improved handleability. Furthermore, since the solvent for preheating is heated alone, this can be more easily heated than in the case of heating the preliminary mixture with the coal.

The preheating step preferably has a heating temperature of 100° C. or more and 250° C. or less. By thus regulating the coal heating temperature in the preheating step so as to be within that range, moisture in the coal can be removed without fail while preventing the coal from changing in property through pyrolysis. By thus removing the moisture present in the coal without fail, the rapid temperature elevating of the mixture can be prevented from resulting in an abrupt pressure increase due to water gas. As a result, the step of removing moisture performed in the stage of feed material preparation can be omitted.

The extraction solvent heating step preferably has a heating temperature of or more and 450° C. or less. By thus regulating the extraction solvent heating temperature in the extraction solvent heating step so as to be within that range, the temperature of the mixture of the coal and the extraction solvent is elevated, without fail, to an extraction temperature which brings about a higher degree of extraction. Consequently, the degree of extraction of the solvent-soluble components in the coal heating step is improved more reliably.

The preheating step preferably has a heating rate of 5° C./min or more and 200° C./min or less. By thus regulating the rate of heating the coal in the preheating step so as to be within that range, moisture in the coal can be more reliably removed in the preheating step. Consequently, the time period for elevating the temperature of the coal in the coal heating step can be further shortened.

It is desirable that in the preheating step, a waste heat resulting from the solvent separation step should be utilized to preheat the coal. By thus utilizing the waste heat from the solvent separation step to preheat the coal in the preheating step, the cost of heating the mixture of the coal and the extraction solvent can be further reduced.

It is desirable that the mixing in the cord heating step should be conducted while keeping the extraction solvent in a turbulent-flow state. By thus conducting the mixing in the coal heating step while keeping the extraction solvent in a turbulent-flow state, the mixing of the coal with the extraction solvent in the coal heating step is accelerated and a larger amount of solvent-soluble components can be dissolved in the extract ion solvent.

Effects of the Invention

As explained above, according to the process of the present invention for producing an ash-free coal, the time period for extracting solvent-soluble components can be shortened at low cost.

MODES FOR CARRYING OUT THE INVENTION

Embodiments of the apparatus for producing an ash-free coal and of the process for producing an ash-free coal according to the present invention are explained below in detail.

First Embodiment

Figure 1:
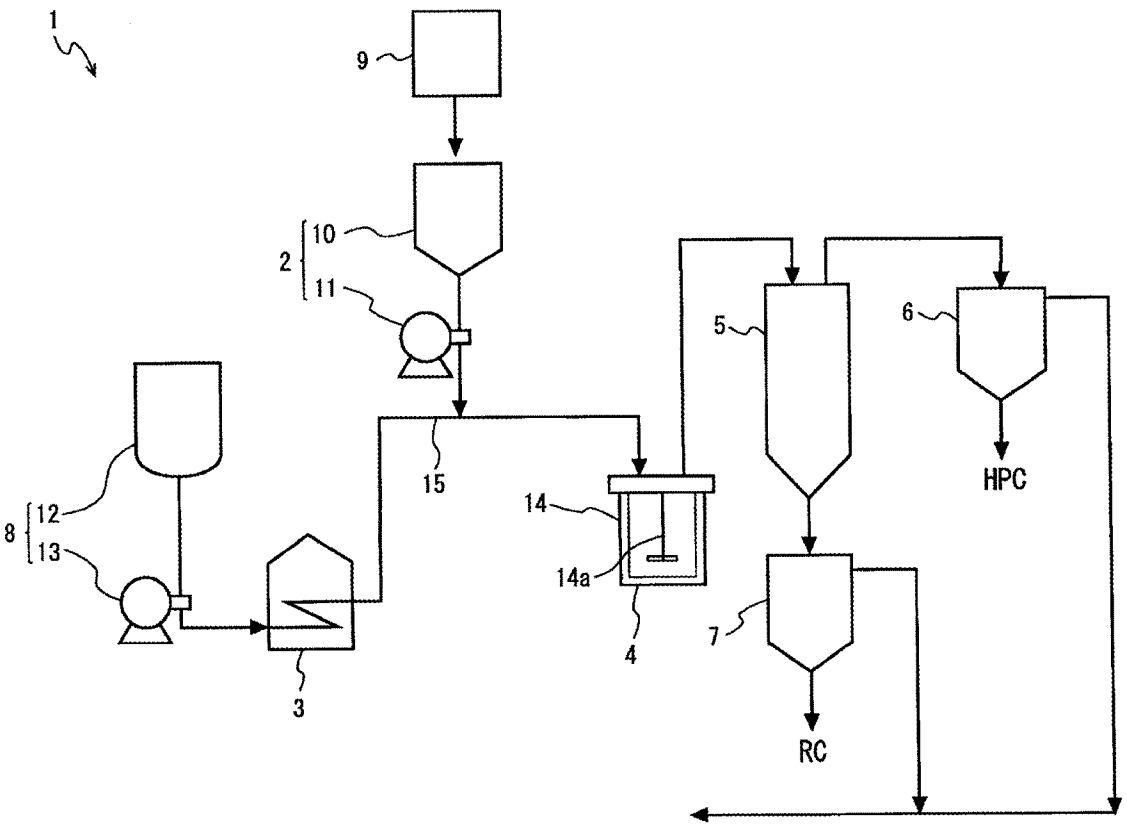
FIG. 1 is a diagrammatic view which illustrates an ash-free coal production apparatus according to a first embodiment of the present invention.

The ash-free coal production apparatus 1 in FIG. 1 mainly includes a preheating part 2 for preheating a coal, an extraction solvent heating part 3 for heating an extraction solvent, a main heating part 4 for mixing the coal after the preheating with the extraction solvent heated to a temperature higher than the temperature of the coal, a separation part 5 for separating a solution containing coal components dissolved therein from the mixture of the coal and the extraction solvent, and a first vaporization part 6 for separating the extraction solvent form the solution by vaporization. In the ash-free coal production apparatus 1, an ash-free coal (HPC) is obtained by separating the extraction solvent from the solution by vaporization in the first vaporization part 6. The ash-free coal production apparatus 1 further includes a preparation part 9 for mixing a solvent for preheating with the coal, an extraction solvent feed part 8 for supplying the extraction solvent, and a second vaporization part 7 for obtaining a by-product coal (RC) from a high-solid-content liquid which has been separated in the separation part 5 and contains coal components insoluble in the extraction solvent (hereinafter referred to as "solvent-insoluble components"). In the preheating part 2, the preliminary mixture obtained by mixing the solvent for preheating with the coal in the preparation part 9 is preheated.

Extraction Solvent Feed Part

The extraction solvent feed part 8 supplies an extraction solvent to the main heating part 4. The extraction solvent feed part 8 includes an extraction solvent tank 12 and an extraction-solvent compression transport pump 13.

Extraction Solvent Tank

The extraction solvent tank 12 is for storing therein an extraction solvent to be mixed with the preheated preliminary mixture supplied from the preheating part 2. The extraction solvent to be mixed with the preheated preliminary mixture is not particularly limited so long as coals dissolve therein. However, coal-derived bicyclic aromatic compounds are, for example, suitable for use. Since the bicyclic aromatic compounds are akin in basic structure to the structural molecules of coals, they base a high affinity for coals and a relatively high degree of extraction can be obtained therewith. Examples of the coal-derived bicyclic aromatic compounds include methylnaphthalene oil and naphthalene oil, which are oils obtained by distilling by-product oils yielded when a coke is produced by coal carbonization.

The extraction solvent is not particularly limited in the boiling point thereof. For example, a lower limit of the boiling point of the extraction solvent is preferably 180° C., more preferably 230° C. Meanwhile, an upper limit of the boiling point of the extraction solvent is preferably 300° C., more preferably 280° C. In the case where the boiling point of the extraction solvent is below the lower limit, there is a possibility that recovery of the extraction solvent in the first vaporization part 6 and second vaporization part 7, which will be described later and in which the extraction solvent is separated by vaporization, might result in an increased loss due to volatilization and hence in a decrease in the recovery rate of the extraction solvent. Conversely, in the case where the boiling point of the extraction solvent exceeds the upper limit, it is difficult to separate the solvent-soluble components form the extraction solvent and there is a possibility in this case also that the recovery rate of the extraction solvent might decrease.

Extraction-Solvent Compression Transport Pump

The extraction-solvent compression transport pump 13 has been disposed in a line which connects the extraction solvent tank 12 to the main heating part 4. The extraction-solvent compression transport pump 13 compression-transports an extraction solvent stored in the extraction solvent tank 12 to the main heating part 4 through a main feed pipe 15.

The kind of the extraction-solvent compression transport pump 13 is not particularly limited so long as if can compression-transport the extraction solvent to the main heating part 4 through the main feed pipe 15. For example, a displacement type pump or a non-displacement type pump can be used. More specifically, a diaphragm pump or a tubephragm pump can be used as the displacement type pump, and a vortex pump or the like can be used as the non-displacement type pump.

With the extraction-solvent compression transport pump 13, the extraction solvent may be compression-transported in a turbulent-flow state through the main feed pipe 15. By mixing the extraction solvent in a turbulent-flow state with a preheated preliminary mixture, this extraction solvent is caused to collide violently with the preliminary mixture being supplied from the preheating part 2, thereby more quickly dissolving the coal. As a result, not only a further reduction in extraction period is attained but also the degree of extraction is further improved. The term "turbulent-flow state" herein means, for example, a state in which the Reinolds' number Re is 2,100 or larger, more preferably a state in which the Reinolds' number Re is 4000 or larger.

Extraction Solvent Heating Part

The extraction solvent heating part 3 heats an extraction solvent which has been compression-transported by the extraction-solvent compression transport pump 13. The extraction solvent heating part 3 is not particularly limited so long as it can heat the extraction solvent. In general, however, a heat exchanger is used as the extraction solvent heating part 3. In the case of using a heat exchanger as the extraction solvent heating part 3, the extract solvent flowing through the pipeline undergoes heat exchange when passing through the extraction solvent heating part 3 and is heated thereby. As the heat exchanger to be used as the extraction solvent heating part 3, use is made of, for example, a heat exchanger of the multitubular type, plate type, spiral type, or the like. In the ash-free coal production apparatus 1 illustrated in FIG. 1, the extraction solvent heating part 3 has been disposed downstream from the extraction-solvent compression transport pump 13 of the extraction solvent feed part 8 to heat the extraction solvent compression-transported by the extraction-solvent compression transport pump 13. However, an extraction solvent which has been heated in advance in an extraction solvent heating part 3 may be compression-transported by an extraction-solvent compression transport pump 13. Namely, in FIG. 1, the disposition of the extraction-solvent compression transport pump 13 and extraction solvent heating part 3 may be reversed.

In the main heating part 4, the temperature (the extraction temperature) of the mixture of the preliminary mixture and the extraction solvent, with which a high degree of extraction can be obtained, is about 300° C. or more and 420° C. or less. If is therefore preferable that an extraction solvent having such a temperature that the mixture obtained by mixing this extraction solvent with the preliminary mixture in the main heating part 4 has such extraction temperature should be supplied to the main heating part 4. Since the preliminary mixture which has been preheated and is supplied from the preheating part 2 has a temperature lower than the extraction temperature, the extraction solvent which has been heated in the extraction solvent heating part 3 decreases in temperature upon mixing with the preliminary mixture. It is hence desirable that the extraction solvent should be heated to or above the temperature of the mixture within the main heating part 4. From this standpoint, a lower limit of the temperature of the extraction solvent located downstream from the extraction solvent heating part 3 is preferably 330° C., more preferably 380° C. Meanwhile, an upper limit of the temperature of this extraction solvent is preferably 450° C., more preferably 430° C. In the case where the temperature of the extraction solvent is below the lower limit, the temperature of the mixture obtained by mixing this extraction solvent with the preheated preliminary mixture is less apt to be elevated to the extraction temperature in the main heating part 4. There is hence a possibility that the bonds between the molecules constituting the coal cannot be sufficiently weakened, resulting in a decrease in the degree of extraction. Conversely, in the case where the temperature of the extraction solvent exceeds the upper limit, the mixture in the main heating part 4 has too high a temperature and there is a possibility that pyrolysis radicals which have generated by pyrolytic reactions of the coal undergo recombination, resulting in a decrease in the degree of extraction. The temperature of the extraction solvent located downstream from the extraction solvent heating part 3 means the temperature of the extraction solvent at the outlet of the extraction solvent heating part 3.

The extraction solvent heating part 3 heats the extraction solvent to a temperature within that range during the period when the extraction solvent flowing through the main feed pipe 15 passes through the extraction solvent heating part 3. There is no particular limitation on the period of heating in the extraction solvent heating part 3, but it is, for example, 10 minutes or more and 30 minutes or less. The extraction solvent has been heated beforehand by utilizing waste heat in order to heighten thermal efficiency, and the temperature of the extraction solvent before passing the extraction solvent heating part 3 is about 100° C. Consequently, it is preferable that the extraction solvent heating part 3 should be one which is capable of heating the extraction solvent at a heating rate of about 10° C. or more and 100° C. or less per minute. The extraction solvent need not be preheated before it passes through the extraction solvent heating part 3.

It is preferable that the extraction solvent heating part 3 should heat the extraction solvent at a high pressure. A lower limit of the pressure at which the extraction solvent heating part 3 heats the extraction solvent is preferably 1 MPa, more preferably 2 MPa, although it depends on the vapor pressure of the extraction solvent, etc. Meanwhile, an upper limit of the pressure is preferably 5 MPa, more preferably 4 MPa. In the case where the pressure at which the extraction solvent heating part 3 heats the extraction solvent is below the lower limit, there is a possibility that the extraction solvent might volatilize, making it difficult to exact the solvent-soluble components in the main heating part 4, which will be described later. Conversely, in the case where the pressure exceeds the upper limit, there is a possibility that the equipment cost and the operating cost might increase.

Preparation Part

In the preparation part 9, a solvent for preheating is mixed with a coal to obtain a pasty preliminary mixture. The preparation part 9 is a mixer, and a coal and a solvent for preheating are introduced in given amounts into the mixture and stirred and mixed by the mixer to thereby obtain a preliminary mixture. The mixer to be used here is not particularly limited so long as it is capable of accommodating high viscosities. For example, a mortar mixer, a concrete mixer or the like can be used. Although it seems to be preferable that the period of stirring and mixing should be longer, the period is preferably about 1 hour or more and 3 hours or less from the standpoint of production efficiency.

As the coal to be mixed with the solvent for preheating, coals of various ranks can be used. For example, bituminous coal, which shows a high degree of extraction, and less expensive low-rank coals (sub-bituminous coal and brown coal) are suitable for use. With respect to a coal classification by particle diameter, finely ground coals are suitable for use. The term "finely ground coal" herein means a coal in which the proportion by mass of coal particles each having a particle diameter less than 1 mm to the total mass of the coal is, for example, 80% or higher. A lump coal can also be used as the coal to be mixed in the preparation part 9 with the solvent for preheating. The term "lump coal" herein means a coal in which the proportion by mass of coal particles each having a particle diameter of 5 mm or larger to the total mass of the coal is, for example, 50% or higher. Since lump coals have larger coal particle diameters than the finely ground coals, a higher rate of separation in the separation part 5, which will be described later is attained and the efficiency of sedimentation can be heightened. The term "particle diameter" herein means a value measured in accordance with JIS-Z8815 (1994); Test sieving, General requirements. For classifying a coal by particle diameter, use can be made, for example, of metal wire cloth as provided for in JIS-Z8801-1 (2006).

A lower limit of the content of particles having a particle diameter of 1 mm or less in the coal to be mixed with the solvent for preheating is preferably 5% by mass, more preferably 10% by mass. The smaller the particle diameters of the coal, the more preferred. The content may be any value of 100% by mass or less. In the case where the content thereof is less than the lower limit, there is a possibility that mixing with the solvent for preheating might be difficult, resuming in a prolongation of the period for preparing the preliminary mixture.

The solvent for preheating is not particularly limited. However, preferred is a solvent which facilitates separation of an ash-free coal and a by-product coal from the supernatant and high-solid-content liquid that have been separated in the separation part 5, which will be described later. Specifically, coal-derived bicyclic aromatic compounds, for example, are suitable for use as the solvent for preheating. Examples of the coal-derived bicyclic aromatic compounds include methylnaphthalene oil and naphthalene oil, which are oils obtained by distilling by-product oils yielded when a coke is produced by coal carbonization. From the standpoint of solvent recycling, it is especially preferable that, as the solvent for preheating, a solvent of the same kind as the extraction solvent supplied from the extraction solvent feed part is should be used.

A lower limit of the coal concentration (dry coal basis) in the preliminary mixture is preferably 40% by mass, more preferably 50% by mass. Meanwhile, an upper limit of the coal concentration therein is preferably 70% by mass, more preferably 60% by mass. In the case where the coal concentration is less than the lower limit, the proportion of the solvent for preheating contained in this preliminary mixture is too high and, hence, the extraction solvent must be made to have a higher temperature in order to elevate the temperature of the same amount by mass of the coal to an extraction temperature, resulting in a possibility that the amount of the energy required for elevating the temperature of the mixture of the coal and the extraction solvent might increase. Conversely, in the case where the coal concentration exceeds the upper limit, the force of bonding between the coal and the solvent for preheating in the preliminary mixture is weak and it is difficult to be mixed with the extraction solvent supplied from the extraction solvent feed part 8, resulting in a possibility that the rate of elevating the temperature of the preliminary mixture might be too low.

Preheating Part

The preheating part 2 preheats the preliminary mixture obtained in the preparation part 9 by mixing a solvent for preheating with a coal and then supplies the preliminary mixture to the main heating part 4. The preheating part 2 includes a preliminary-mixture heater 10, which heats the preliminary mixture contained therein, and a preliminary-mixture compression transport pump 11.

The preliminary-mixture heater 10 is, for example, a coal heater of the air current vessel type, and the preliminary mixture stored in the preliminary-mixture heater 10 is preheated thereby.

A lower limit of the preheating temperature for the preliminary mixture in the preliminary-mixture heater 10 is preferably 100° C., more preferably 150° C. Meanwhile, an upper limit of the preheating temperature for the preliminary mixture is preferably 250° C., more preferably 200° C. In the case where the preheating temperature for the preliminary mixture is below the lower limit, not only there is a possibility that the moisture in the coal cannot be completely removed, but also it is necessary to heighten the heating temperature for the extraction solvent, resulting in a possibility that the operating cost cannot be sufficiently reduced. Conversely, in the case where the preheating temperature for the preliminary mixture exceeds the upper limit, there is a possibility that the coal might suffer a property change due to pyrolysis.

The rate of heating the preliminary mixture in the preliminary-mixture heater 10 is not particularly limited. However, a lower limit of the rate of heating the preliminary mixture is preferably 5° C./min, more preferably 10° C./min. Meanwhile, an upper limit of the rate of heating the preliminary mixture is preferably 200° C./min, more preferably 120° C./min. In the case where the rate of heating the preliminary mixture is less than the lower limit, a longer period is required for preheating the preliminary mixture, resulting in a possibility that the steps for ash-free coal production as a whole might necessitate a prolonged period. Conversely, in the case where the rate of heating the preliminary mixture exceeds the upper limit the moisture of the coal cannot be sufficiently removed in the preliminary-mixture heater 10, resulting in a possibility that the temperature elevating of the coal in the main heating part 4 might necessitate a prolonged period.

The preliminary mixture may be rapidly heated and thereafter kept hot for a given period until it is supplied to the main heating part 4. The temperature-holding period dating which, after the preliminary mixture has been heated, the preliminary mixture is kept at 100° C. or higher is not particularly limited. However, a lower limit of the temperature-holding period is, for example, preferably 30 minutes, more preferably 1 hour. Meanwhile, an upper limit of the temperature-holding period is, for example, preferably 3 hours, more preferably 2 hours. In the case where the temperature-holding period is less than the lower limit, the period of supplying, the preliminary mixture from the preheating part 2 to the main heating part 4 is too short, resulting in the possibility of imposing design limitations. Conversely in the case where the temperature-holding period exceeds the upper limit the amount of the energy required for the temperature holding increases, resulting in a possibility that the operating cost might increase.

The preliminary-mixture compression transport pump 11 has been disposed between the preliminary-mixture heater 10 and the main feed pipe 15, and the preliminary mixture which has been preheated and is present in the preliminary-mixture heater 10 is continuously compression-transported to the main feed pipe 15.

The preliminary-mixture compression transport pump 11 is not particularly limited so long as high-viscosity fluids can be compression-transported thereby. For example, use can be made of a mohno pump, sine pump, diaphragm pump, bellows pump, rotary pump, or the like. Especially preferred of these pumps is the mohno pump because the efficiency does not decrease even when the fluid viscosity increases.

A lower limit of the ratio of the mass of the solvent for preheating which is contained in the preliminary mixture supplied from the preheating part 2 to the mass of the extraction solvent compression-transported through the main feed pipe 15 is preferably 1/20. Meanwhile an upper limit of the ratio is preferably 1, more preferably 1/2. In the case where the ratio is less than the lower limit, the coal concentration in the preliminary mixture must be increased, resulting in a possibility that a prolonged period might be required for preparing the preliminary mixture. Conversely, in the case where the ratio exceeds the upper limit, the proportion of the solvent for preheating which is contained in the preliminary mixture to the heated extraction solvent is too high and, hence, the extraction solvent must be made to have a higher temperature in order to elevate the temperature of the same amount by mass of the coal to an extraction temperature, resulting in a possibility that the amount of the energy required for elevating the temperature of the mixture of the coal and the extraction solvent might increase.

Main Heating Part

In the main heating part 4, the extraction solvent supplied from the extraction solvent feed part 8 is mixed with the preliminary mixture after the preheating, which is supplied from the preheating part 2, thereby obtaining a slurry mixture. The main heating part 4 includes an extraction tank 14.

Extraction Tank

To the extraction tank 14 are supplied the extraction solvent and the preliminary mixture after the preheating through the main feed pipe 15. In the extraction tank 14, the extraction solvent and the preliminary mixture after the preheating which have been supplied thereto are mixed together to obtain a slurry mixture, and this mixture is stored for a given time period.

The extraction tank 14 is equipped with a stirrer 14*a*. The extraction tank 14 holds the mixture at a given temperature while stirring it with the stirrer 14*a*, thereby extracting the solvent-soluble components.

The extraction solvent which is being compression-transported through the main feed pipe 15 has a high temperature because is has been heated in the extraction solvent heating part 3, and the temperature thereof is higher than that of the preliminary mixture after the preheating which is being supplied from the preheating part 2. Because of this, the coal contained in the preliminary mixture after the preheating undergoes rapid temperature elevating upon mixing with the extraction solvent in the main feed pipe 15 and in the main heating part 4. The term "rapid temperature elevating" herein means heating at a heating rate of, for example, 10° C. or more and 500° C. or less per second, this heating rate being higher than that in the extraction solvent heating part 3. Although the extraction solvent which is flowing through the main feed pipe 15 has been heated to a temperature higher than an extraction temperature, the heat of this extraction solvent is used for elevating the temperature of the preliminary mixture, when coming into contact with the preliminary mixture after the preheating, which has a temperature lower than the extraction temperature. Because of this, the temperature of the extraction solvent being supplied to the extraction tank 14 becomes lower than the temperature of the extraction solvent heated in the extraction solvent heating part 3. As a result, the temperatures of the extraction solvent and preliminary mixture both change so as so approach an extraction temperature (about 300° C. or more and 420° C. or less) as the extraction solvent and the preliminary mixture move within the main feed pipe 15 to the extraction tank 14. Thus, the slurry mixture obtained by mixing the extraction solvent with the preliminary mixture and present in the extraction tank 14 has the extraction temperature.

A lower limit of the holding temperature at which the mixture of the extraction solvent and the preliminary mixture is held in the extraction tank 14 is preferably 300° C., more preferably 350° C. Meanwhile, an upper limit of the holding temperature for the mixture is preferably 420° C., more preferably 400° C. In the case where the holding temperature for the mixture is below the lower limit, there is a possibility that the bonds between the molecules constituting the coal cannot be sufficiently weakened, resulting in a decrease in the degree of extraction. Conversely, in the case where the holding temperature for the mixture exceeds the upper limit, there is a possibility that pyrolytic reactions of the coal take place highly vigorously and the recombination of yielded pyrolysis radicals occurs, resulting in a decrease in the degree of extraction.

It is preferable that the thermal extraction of the mixture in the extraction tank 14 should be conducted in a nonoxidizing atmosphere. Specifically, it is preferred to conduct the thermal extraction of the mixture in the presence of an inert gas, e.g., nitrogen. By using an inert gas, e.g., nitrogen, the mixture can be prevented, at low cost, from coming into contact with oxygen to ignite during the thermal extraction.

The pressure at which the thermal extraction of the mixture is performed can be, for example, 1 MPa or more and 3 MPa or less, although it depends on the heating temperature and the vapor pressures of the extraction solvent and solvent for preheating used. In the case where the pressure during the thermal extraction is lower than the vapor pressure of the extraction solvent or solvent for preheating, there is a possibility that the extraction solvent or the solvent for preheating might volatilize and the solvent-soluble components might not be sufficiently extracted. Meanwhile, in the case where the pressure during the thermal extraction is too high, the apparatus cost, operating cost, etc. increase.

Separation Part

In the separation part 5, a solution containing solvent-soluble components dissolved therein is separated from the mixture obtained by mixing in the main heating part 4.

Specifically, the separation of the solution in the separation part 5 is conducted by a gravitational settling method, so that the mixture obtained by mixing the extraction solvent with the preliminary mixture in the main heating part 4 is separated into a solution containing solvent-soluble components dissolved therein and a high-solid-content liquid containing solvent-insoluble components. The gravitational settling method is a separation method for solid-liquid separation in which the solid matter is caused to settle by gravity. The term "solvent-insoluble components" means an extraction residue which is configured mainly of ash matter and insoluble coal that are insoluble in both the extraction solvent and the solvent for preheating and which further contains the extraction solvent and the solvent for preheating.

In the ash-free coal production apparatus 1, the mixture is continuously supplied into the separation part 5 and, simultaneously therewith, the solution containing solvent-soluble components can be discharged from an upper part and the high-solid-content liquid containing solvent-insoluble components can be discharged from a lower part. Thus, a continuous solid-liquid separation treatment is rendered possible.

The solution containing solvent-soluble components accumulates in the upper part of the separation part 5. This solution is filtered with a filter unit (not shown) according to need, and is then discharged into a first vaporization part 6. Meanwhile, the high-solid-content liquid containing solvent-insoluble components accumulates in the lower part of the separation part 5, and is discharged to a second vaporization part 7.

The time period during which the mixture is held in the separation part 5 is not particularly limited. However, it is, for example, 30 minutes or more and 120 minutes or less. During this period, the sedimentation in the separation part 5 conducted. In the case of using a lump coal as the coal, the sedimentation proceeds more efficiently and, hence, the period during which the mixture is held in the separation part 5 can be shortened.

It is preferable that the inside of the separation part 5 should be heated and pressurized. A lower limit of the heating temperature for the inside of the separation part 5 is preferably 300° C. more preferably 350° C. Meanwhile, an upper limit of the heating temperature for the inside of the separation part 5 is preferably 420° C., more preferably 400° C. In the case where the heating temperature is below the lower limit, there is a possibility that the solvent-soluble components might precipitate again, resulting in a decrease in separation efficiency. Conversely, in the case where the heating temperature exceeds the upper limit, there is a possibility that the operating cost for heating might increase.

A lower limit of the pressure inside the separation part 5 is preferably 1 MPa, more preferably 1.4 MPa. Meanwhile, an upper limit of the pressure is preferably 3 MPa, more preferably 2 MPa. In the case where the pressure is less than the lower limit, there is a possibility that the solvent-soluble components might precipitate again, resulting in a decrease in separation efficiency. Conversely, in the case where the pressure exceeds the upper limit, there is a possibility that the operating cost for pressurizing might increase.

Methods for separating the solution and the high-solid-content liquid are not limited to the gravitational settling method, and use may be made, for example, of a filtration method or a centrifugal separation method. In the case of using a filtration method or centrifugal separation method as a solid-liquid separation method, a filter, a centrifugal separator or the like is used as the separation part 5.

First Vaporization Part

In the first vaporization part 6, the extraction solvent and the solvent for preheating are separated by vaporization from the solution separated in the separation part 5, thereby obtaining an ash-free coal (HPC).

As a method whereby the extraction solvent and the solvent for preheating are separated by vaporization, use can be made of separation methods including general distillation methods and vaporization methods (e.g., spray drying method). The extraction solvent which has been separated and recovered can be circulated to a pipeline upstream from the extraction solvent heating part 3 and used repeatedly. In the case where a solvent which is of the same kind as the extraction solvent is used as the solvent for preheating, this solvent for preheating can also be separated and recovered and be circulated to a pipeline upstream from the extraction solvent heating part 3 or to the preparation part 9 and used repeatedly. By the separation and recovery of the extraction solvent and the solvent for preheating from the solution, an ash-free coal containing substantially no ash matter can be obtained from the solution.

The ash-free coal thus obtained has an ash content of 5% by mass or less or of 3% by mass or less, i.e., contains almost no ash matter, and contains completely no moisture. It shows a higher calorific value than, for example, the feed coal. Furthermore, this ash-free coal has greatly improved plasticity and fusibility, which is an especially important quality of feed materials for steelmaking cokes. For example, it shows far higher flowability than the feed coal. Consequently, the ash-free coal can be used as a blending coal for feed materials for cokes.

Second Vaporization Part

In the second vaporization part 7, the extraction solvent and the solvent for preheating are separated by vaporization from the high-slid-content liquid separated in the separation part 5, thereby obtaining a by-product coal (RC).

As a method whereby the extraction solvent and the solvent for preheating are separated from the high-solid-content liquid, use can be made of general distillation methods and vaporization methods (e.g., spray drying method) as in the methods for separation in the first vaporization part 6. The extraction solvent which has been separated and recovered can be circulated to a pipeline upstream from the extraction solvent heating part 3 and used repeatedly. In the case where a solvent which is of the same kind as the extraction solvent is used as the solvent for preheating, this solvent for preheating can also be separated and recovered and be circulated to a pipeline upstream from the extraction solvent heating part 3 or to the preparation part 9 and used repeatedly. By the separation and recovery of the extraction solvent and the solvent for preheating, a by-product coal in which solvent-insoluble components including ash matter, etc. have been concentrated can be obtained from the high-solid-content liquid. The by-product coal shows neither plasticity nor fusibility, but oxygen-containing functional groups have been eliminated therefrom. Because of this, the by-product coal, when used as a blending coal, does not inhibit the plasticity and fusibility of other coals included in this coal blend. Consequently, this blending coal can be used as some of a blending coal as a feed material for cokes. The blending coal can be discarded without being recovered.

Process for Producing Ash-Free Coal

This process for producing an ash-free coal includes a step in which a coal is preheated (preheating step), a step in which an extraction solvent is heated (extraction solvent heating step), a step in which the coal after the preheating is mixed with the extraction solvent which has been heated to a temperature higher than the temperature of the coal, thereby heating the coal (coal heating step), a step in which a solution containing coal components dissolved therein is separated from the mixture of the coal and the extraction solvent (solution separation step), a step in which the extraction solvent is separated from the solution by vaporization (solvent vaporization-separation step), and a step in which the extraction solvent is separated by vaporization from a high-solid-content liquid separated in the solution separation step, thereby obtaining a by-product coal (by-product coal acquisition step). An explanation is given below on this process for ash-free coal production in which the ash-free coal production apparatus 1 of FIG. 1 is used.

Preheating Step

The preheating step includes a step in which a solvent for preheating is mixed with a coal (preheating-solvent mixing step) and a step in which the preliminary mixture of the coal and the solvent for preheating is heated (preliminary-mixture heating step).

Preheating-Solvent Mixing Step

In the preheating-solvent mixing step, a solvent for preheating is mixed with a coal to obtain a pasty preliminary mixture. Specifically, given amounts of a coal and a solvent for preheating are introduced into the preparation part 9, and are stirred and mixed in the preparation part 9, thereby obtaining a preliminary mixture.

Preliminary-Mixture Heating Step

In the preliminary mixture heating step, the preliminary mixture obtained in the preheating-solvent mixing step is heated. Specifically, the preliminary mixture obtained by mixing in the preparation part 9 is transported into the preliminary-mixture heater 10 and the preliminary mixture is heated to a given preheating temperature in the preliminary-mixture heater 10.

In the preheating step described hereinabove, the preliminary mixture prepared in the preparation part 9 is preheated in the preheating part 2. However, use may be made of a method in which only the solvent for preheating is heated beforehand and a coal is mixed with the heated solvent for preheating, thereby elevating the temperature of the coal to a preheating temperature. For example, the preheating step may be a step that includes a step in which a solvent for preheating is heated and a step in which the heated solvent for preheating is mixed with a coal. Namely, the ash-free coal production apparatus may be configured so that the preheating part include a preheating-solvent heating part for heating a solvent for preheating and a preheating coal mixing part for mixing the heated solvent for preheating with a coal. In this case, a solvent for preheating is heated in the preheating-solvent heating part to a temperature higher than the preheating temperature for the preliminary mixture, and the thus-heated solvent for preheating is mixed with a normal-temperature coal in the preheating coal mixing part, thereby obtaining a preliminary mixture having the preheating temperature. In this case, the heating of only the solvent for preheating is easier than the preliminary mixture of the solvent for preheating and the coal.

In the preheating step, waste heat from other steps may be utilized as a heat source for preheating the preliminary mixture. For example, the heat of the solvents recovered as vapors in the solvent vaporization-separation step and by-product coal acquisition step, which will be described later, may be utilized to heat the preliminary mixture. Thus, the operating cost for preheating can be reduced.

Furthermore, the solvent recovered in the solvent vaporization-separation step or by-product coal acquisition step may be used as the solvent for preheating in the preheating step. After heat is recovered by heat exchange from the solvent which has been recovered as a vapor in these steps and which had a temperature of, for example, about 265° C., the solvent still retains heat of, for example, about 248° C. Because of this, by merely mixing this solvent with a normal-temperature coal having a temperature of, for example, 20° C., a preliminary mixture heated to, for example, about 150° C. can be obtained. This heated preliminary mixture is further heated to, for example, about 240° C. by the heat obtained by the heat exchange and then supplied to the main heating part 4. Thus, the solvent recovered in the solvent vaporization-separation step or by-product coal acquisition step can be utilized as the solvent for preheating, and the operating cost for preheating can be further reduced thereby.

Extraction Solvent Heating Step

In the extraction solvent heating step, an extraction solvent is heated. Specifically, by the extraction solvent heating part 3, which has been disposed in the line that connects the extraction solvent tank 12 to the main heating part 4, the extraction solvent which is flowing through the pipeline is heated to an unmixed-solvent temperature Ts1 that is higher than an extraction temperature (e.g., about 380° C.). As a result, the heated extraction solvent is supplied to the main heating part 4 through the main feed pipe 15.

Waste heat from other steps may be utilized as a heat source for heating the extraction solvent in the extraction solvent heating step. For example, the heat of the solvents recovered as vapors in the solvent vaporization-separation step and by-product coal acquisition step, which will be described later, may be utilized to neat the extraction solvent to the given temperature. Thus, the operating cost for heating the extraction solvent can be reduced. Furthermore, since the solvent recovered in the solvent vaporization-separation step or by-product coal acquisition step retains heat of, for example, about 248° C., the operating coal for heating the extraction solvent can be reduced by reusing such recovered solvents as the extraction solvent.

Coal Heating Step

In the coal heating step, the extraction solvent and the preliminary mixture which has been preheated are mixed with each other to obtain a slurry mixture. The coal heating step includes a solvent supply step and a compression transport step.

Solvent Supply Step

In the solvent supply step, the extraction solvent is supplied to the main heating part 4. Specifically, the extraction solvent stored in the extraction solvent tank 2 is compression-transported by the extraction-solvent compression transport pump 13 to the main heating part 4 through the main feed pipe 15. The extraction solvent to be supplied to the main heating part 4 by the extraction-solvent compression transport pump 13 may be compression-transported in a turbulent-flow state through the main feed pipe 15 and mixed with the preliminary mixture after the preheating in order to facsimile the mixing of the extraction solvent with the preliminary mixture.

Compression Transport Step

In the compression transport step, the preliminary mixture which has been preheated in the preheating step is supplied to the main heating part 4 through the main feed pipe 15. Specifically, the preliminary mixture heated to a preheating temperature in the preliminary-mixture heater 10 is compression-transported by the preliminary-mixture compression transport pump 11 to the main heating part 4 through the main feed pipe 15.

The extraction solvent and preliminary mixture after the preheating which have been supplied by the solvent supply step and compression transport step are mixed with each other in the extraction tank 14 to obtain a slurry mixture. Furthermore, in the extraction tank 14, this mixture is held at an extraction temperature for a given time period to extract solvent-soluble components. When the extraction solvent and the preliminary mixture are supplied to the extraction tank 14, the temperature of the coal contained in the preheated preliminary mixture is rapidly elevated by the heated extraction solvent to become the extraction temperature. As a result, the solvent-soluble components are speedily extracted within the extraction tank 14.

Figure 2A:
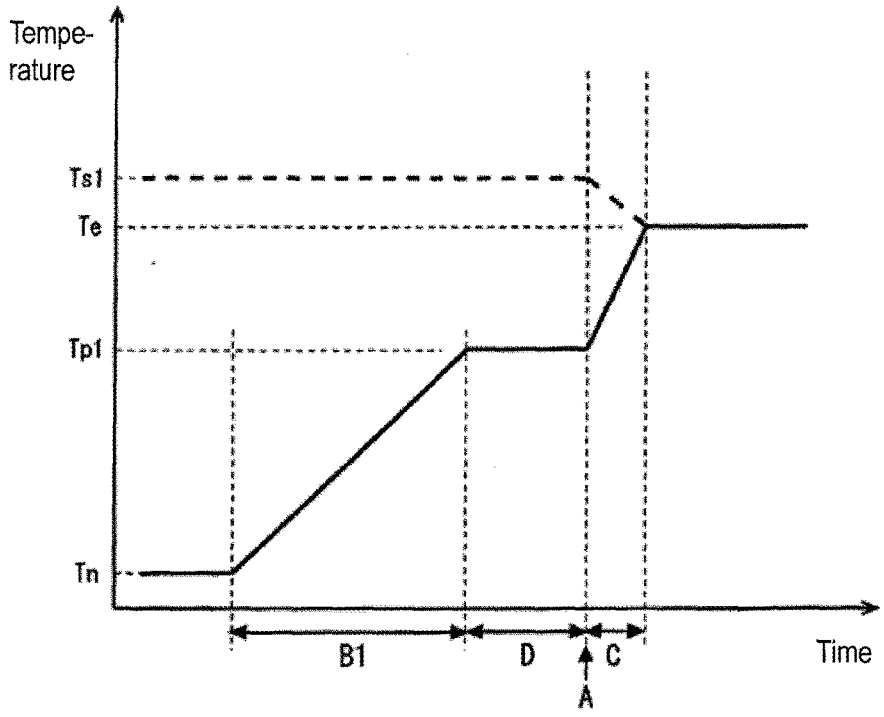
FIG. 2A is a graph which illustrates temperature changes of a preliminary mixture and an extraction solvent in the ash-free coal production apparatus of FIG. 1.

FIG. 2A is a drawing which illustrates temperature changes of a preliminary mixture and an extraction solvent in the ash-free coal production apparatus 1 of FIG. 1. As illustrated in FIG. 2A, the preliminary mixture having normal temperature Tn which has been supplied from the preparation part 9 is heated with the preliminary-mixture heater 10 for a coal preheating period B1, thereby heating the preliminary mixture to a preheating temperature Tp1 (e.g., about 200° C. or more and 250° C. or less). This preliminary mixture is supplied to the main heating part 4 in a temperature holding period D, during which it is kept hot so as to maintain the preheating temperature Tp1.

At the coal introduction point A in FIG. 2A, the preliminary mixture after the preheating is supplied to the main heating part 4 from the preheating part 2. The preliminary mixture having the preheating temperature Tp1 is thus mixed with the extraction solvent having the unmixed-solvent temperature Ts1. As a result, in a rapid-temperature-elevating period C, the temperature of the preliminary mixture is rapidly elevated and the temperature of the coal contained in this preliminary mixture becomes an extraction temperature Te.

Figure 2B:
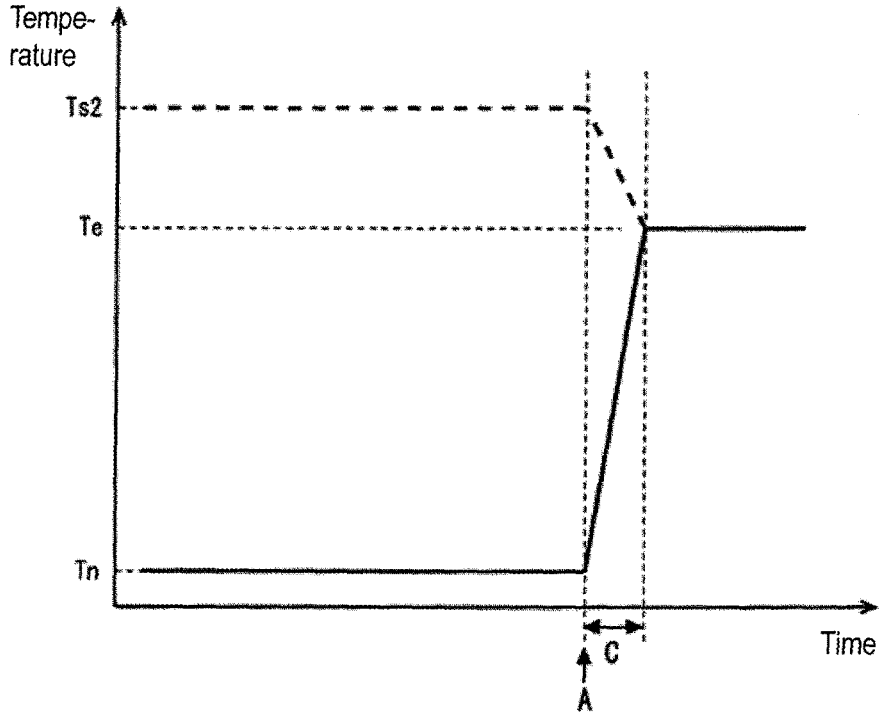
FIG. 2B is a graph which illustrates temperature changes of a preliminary mixture and an extraction solvent in an ash-free coal production apparatus in which the preliminary mixture is not preheated.

In FIG. 2B are illustrated temperature changes of a preliminary mixture and an extraction solvent in the case where the preliminary mixture is not preheated. At the coal introduction point A, the preliminary mixture having normal temperature Tn is mixed with the extraction solvent having an unmixed-solvent temperature Ts2. As a result, in a rapid-temperature-elevating period C, the temperature of the preliminary mixture is rapidly elevated and the temperature of the coal contained in this preliminary mixture becomes the extraction temperature Te. In order to elevate the temperature of the preliminary mixture to the extraction temperature Te in the same rapid-temperature-elevating period C as in FIG. 2A, the extraction solvent to be mixed with the preliminary mixture must be heated beforehand to an unmixed-solvent temperature Ts2 which is higher than the unmixed-solvent temperature Ts1. The higher the temperature of the solvent, the higher the apparatus design pressure. Consequently, in the case of FIG. 2B, the equipment coat and the operating cost are higher than in the case of the ash-free coal production process of FIG. 2A. Namely, according to that ash-free coal production process, the temperature of the mixture of a coal and an extraction solvent can be rapidly elevated while keeping the equipment cost and the operating cost low.

Figure 2C:
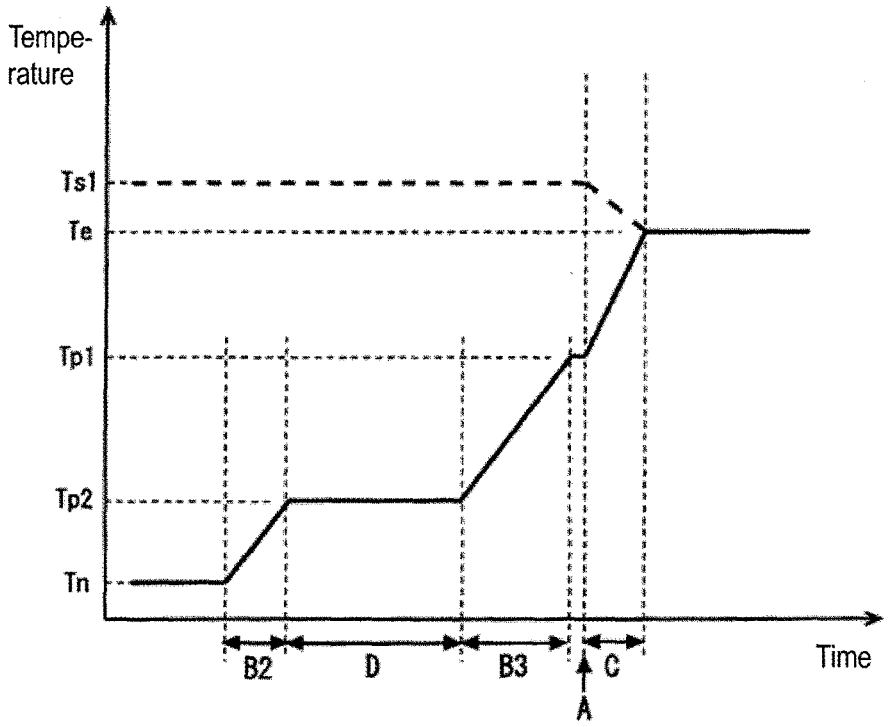
FIG. 2C is a graph which illustrates temperature changes of a preliminary mixture and an extraction solvent in the ash-free coal production apparatus of FIG. 1, the temperature changes being different from those illustrated in FIG. 2A.

Meanwhile, in the ash-free coal production apparatus 1 of FIG. 1, the temperature of a preliminary mixture may be regulated as illustrated in FIG. 2C. In this case, in a primary preheating period B2, a preliminary mixture having normal temperature in which has been supplied from the preparation part 9 is heated to a primary preheating temperature Tp2 (e.g., about 100° C.) which is lower than the preheating temperature Tp1. In a temperature holding period D, this preliminary mixture is kept hot so that the temperature thereof is kept at the primary preheating temperature Tp2. In a secondary preheating period B3, which is just before feeding to the main heating part 4, the preliminary mixture is further heated to the preheating temperature Tp1. By thus regulating the temperature of the preliminary mixture, not only the amount of the energy required for keeping the preliminary mixture hot can be reduced, but also the preliminary mixture can be heated to the preheating temperature Tp1 in a shorter time period in accordance with the timing of the coal introduction point A of supplying to the main heating part 4. For example, use of preliminary-mixture temperature regulation such as that in FIG. 2C is preferred in the case where the solvents recovered in the solvent vaporization-separation step and by-product coal acquisition step are used as a solvent for preheating and where the waste heat possessed by the solvents recovered from these steps is utilized for preheating the preliminary mixture, as described above.

Solution Separation Step

In the solution separation step, a solution containing solvent-soluble components dissolved therein and a high-solid-content liquid containing solvent-insoluble components are separated from the mixture obtained by mixing in the coal heating step. Specifically, the mixture discharged from the extraction tank 14 is supplied to the separation part in which the mixture supplied is separated into the solution and the high-solid-content liquid by, for example, a gravitational settling method.

Solvent Vaporization-Separation Step

In the solvent vaporization-separation step, the extraction solvent is separated by vaporization from the solution separated in the solution separation step, thereby obtaining an ash-free coal. Specifically, the solution separated in the separation part 5 is supplied to a first vaporization part 6, and the extraction solvent and the solvent for preheating are vaporized in the first vaporization part 6, thereby separating into the solvents and an ash-free coal.

By-Product Coal Acquisition Step

In the by-product coal acquisition step, a by-product coal is obtained, by separation by vaporization, from the high-solid-content liquid separated in the solution separation step. Specifically, the high-solid-content liquid separated in the separation part 5 is supplied to a second vaporization part 7, and the extraction solvent and the solvent for preheating are vaporized in the second vaporization part 7, thereby separating into the solvents and a by-product coal.

Advantages

In this process for ash-free coal production, since a preliminary mixture of a coal and a solvent for preheating is heated in the preheating part 2 and the preliminary mixture after the preheating is mixed, in the main heating part 4, with an extraction solvent heated to a higher temperature than this preliminary mixture, it is possible to rapidly elevate the temperature of the mixture of the preliminary mixture and the extraction solvent while suppressing the heating temperature of the extraction solvent. Thus, not only the cost of heating the extraction solvent can be reduced, but also the mixture is rapidly heated to a temperature at which solvent-soluble components are apt to be extracted, thereby enabling the solvent-soluble components to be speedily extracted. As a result, by this process for ash-free coal production, the time period for extracting solvent-soluble components can be shortened at low cost.

In addition, since the preliminary mixture of a coal and a solvent for preheating is heated in the preheating part 2 in this process for ash-free coal production, it is easy to improve the efficiency of elevating the temperature of the coal when the coal is mixed with the extraction solvent in the coal heating step. Furthermore, since a preliminary mixture of a coal and a solvent for preheating is handled, more improved handleability is attained than in the case of handling the coal alone.

Second Embodiment

Figure 3:
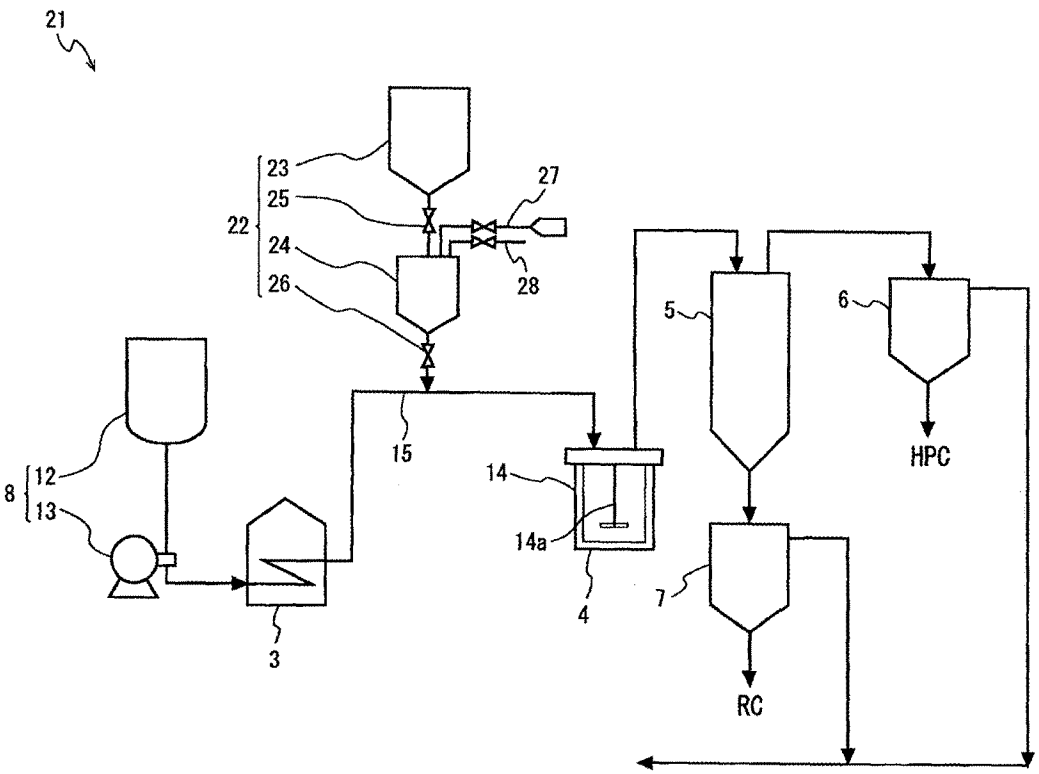
FIG. 3 is a diagrammatic view which illustrates an ash-free coal production apparatus according to a second embodiment of the present invention.

The ash-free coal production apparatus 21 of FIG. 3 differs from the ash-free coal production apparatus 1 of FIG. 1 in the configuration of the preheating part 22 for preheating a coal and in that the apparatus 21 includes no preparation part. Except for these differences, the ash-free coal production apparatus 21 has the same configuration as the ash-free coal production apparatus 1 of FIG. 1. The points other than these are hence designated by the common numerals or signs, and explanations thereon are omitted.

In contrast to the preheating part 2 of the ash-free coal production apparatus 1 of FIG. 1, which preheats a preliminary mixture of a coal and a solvent for preheating, the preheating part 22 of the ash-free coal production apparatus 21 preheats a coal alone. This coal after the preheating is supplied to main heating part 4.

Preheating Part

The preheating part 22 preheats a coal and then supplies the coal to the main heating part 4. The preheating part 22 includes a normal-pressure hopper 23 used in a normal-pressure state, a coal heater 24 which heats a coal contained therein, a first value 25 disposed in a pipeline which connects the normal-pressure hopper 23 to the coal heater 24, and a second valve 26 disposed in a pipeline which connects the coal heater 24 to the main feed pipe 15 of the main heating part 4. The coal heater 24 is a heater which is usable either in a normal-pressure state or in an elevated-pressure state, and a pressurization line 27 for supplying a gas such as nitrogen gas and a gas discharge line 28 for discharging the gas have been connected thereto.

The coal stored in the normal-pressure hopper 23 is first transported to the coal heater 24 by opening the first valve 25 while keeping the second valve 26 closed. In this stage, the coal heater 24 is in a normal-pressure state. The coal heater 24 is, for example, a coal heater of an air current vessel type, and preheats the coal transported into the coal heater 24.

A lower limit of the preheating temperature for the coal in the coal heater 24 is preferably 100° C., more preferably 150° C. Meanwhile, an upper limit of the preheating temperature for the coal is preferably 250° C., more preferably 200° C. In the case where the preheating temperature for the coal is below the lower limit, not only there is a possibility that the moisture in the coal cannot be completely removed, but also it is necessary to heighten the heating temperature for the extraction solvent, resulting in a possibility that the operating cost cannot be sufficiently reduced. Conversely, in the case where the preheating temperature for the coal exceeds the upper limit, there is a possibility that the coal might suffer a property change due to pyrolysis. By regulating the preheating temperature for the coal so as not to be below the lower limit, the moisture in the coal can be removed without fail. Thus, an abrupt pressure increase due to the water gas which may generate upon rapid elevating of the temperature of the coal in the main heating part 4 can be prevented. Consequently, the step of removing moisture in feed-material preparation can be omitted.

After the coal is heated by the coal heater 24 to a preheating temperature within the above-described range, the first valve 25 is closed and a gas such as nitrogen gas is supplied to the coal heater 24 through the pressurization line 27. As a result, the pipelines ranging from the first valve 25 to the second valve 26 and including the coal heater 24 are pressurized and the inside of the coal heater 24 comes into a pressurized state. It is preferred to conduct this pressurization so that the internal pressure of the coal heater 24 becomes equal to or higher than the internal pressure of the main feed pipe 15. Then, the second valve 26 is opened to thereby supply the coal within the coal heater 24 to the main feed pipe 15. By thus bringing the inside of the coal heater 24 into a pressurized state, the coal within the coal heater 24 can be smoothly supplied to the main feed pipe 15. In the preheating part 22 of FIG. 3, the pressurization line 27 and the gas discharge line 28 have been connected to the coal heater 24. However, these may be connected to a pipeline or the like other than the coal heater 24, anywhere between the first valve 25 and the second valve 26.

Here, the kinds of the first valve 25 and second valve 26 are not particularly limited. For example, a gate valve, ball valve, flap valve, rotary valve, or the like can be used as the first valve 25 and the second valve 26.

As the coal to be stored in the normal-pressure hopper 23, use can be made of the similar coal as that to be mixed with the solvent for preheating in the ash-free coal production apparatus 1 of FIG. 1.

Process for Producing Ash-Free Coal

Like the process for ash-free coal production according to the first embodiment, this process for ash-free coal production using the ash-free coal production apparatus 21 of FIG. 3 includes a preheating step, an extraction solvent heating step, a coal heating step, a solution separation step, a solvent vaporization-separation step, and a by-product coal acquisition step. This process for ash-free coal production differs from the process for ash-free coal production according to the first embodiment only in the preheating step and the coal heating step. The preheating step and coal heating step of this process for ash-free coal production are hence explained below.

Preheating Step

In the preheating step, a coal is preheated in the preheating part 22 and supplied to the main heating part 4. Specifically, the coal transported from the normal-pressure hopper 23 to the coal heater 24 is heated to a given temperature lower than an extraction temperature and is then supplied to the main heating part 4. In this step, the coal is supplied to the main heating part 4 while keeping the inside of the coal heater 24 in a pressurized state so that the coal can be smoothly supplied into the main feed pipe 15 connected to the main heating part 4.

Coal Heating Step

In the coal heating step, the extraction solvent and the coal which has been preheated are mixed with each other to obtain a slurry mixture. The coal heating step in this process for ash-free coal production includes a solvent supply step and a compression transport step as in the process for ash-free coal production according to the first embodiment. The solvent supply step is the same as in the process for ash-free coal production according to the first embodiment, and an explanation thereon is hence omitted. The compression transport step in this process for ash-free coal production is explained below.

Compression Transport Step

In the compression transport step, the coal which has been preheated in the preheating step is supplied, to the main heating part 4 through the main feed pipe 15. Specifically, the operation described above involving the first valve 25, second valve 26, pressurization line 27, and gas discharge line 28 is repeated, thereby pressurizing the coal supplied in a given amount to the coal heater 24 and intermittently compression-transporting the coal to the main heating part 4 through the main feed pipe 15.

Thereafter, the extraction solvent and the preheated coal which have been supplied by the solvent supply step and compression transport step are mixed with each other in the extraction tank 14 to obtain a slurry mixture. Furthermore, in the extraction tank 14, this mixture is held at an extraction temperature for a given tune period to extract solvent-soluble components. When the extraction solvent and the coal are supplied to the extraction tank 14, the temperature of the coal, which has been preheated, is rapidly elevated by the extraction solvent, which has been heated. As a result, the mixture obtained by mixing the extraction solvent with the coal has the extraction temperature. Thus, the solvent-soluble components are speedily extracted within the extraction tank 14.

Advantage

In this process for ash-free coal production, there is no need of mixing the coal with a solvent for preheating. The preparation part can hence be omitted, and it is easy to render the apparatus configuration smaller.

Other Embodiments

The apparatus for ash-free coal production and process for ash-free coal production of the present invention should not be construed as being limited to she embodiments shown above.

In the embodiments explained above, the preheating part supplied a preliminary mixture or a coal to the main heating part through the main feed pipe. However, the preliminary mixture or the coal may be directly supplied from the preheating part to the main heating part. Also in such cases where the preliminary mixture or the coal is directly supplied from the preheating part to the main heating part without through the main feed pipe, the solvent-soluble components are speedily extracted because in the main heating part, the preliminary mixture or the coal is speedily mixed with the heated extraction solvent supplied to the main heating part and the temperature thereof is rapidly elevated thereby.

EXAMPLE

The present invention will be explained below in more detail by reference to Example, but the present invention should not be construed as being limited to the following Example.

Example 1

Figure 4:
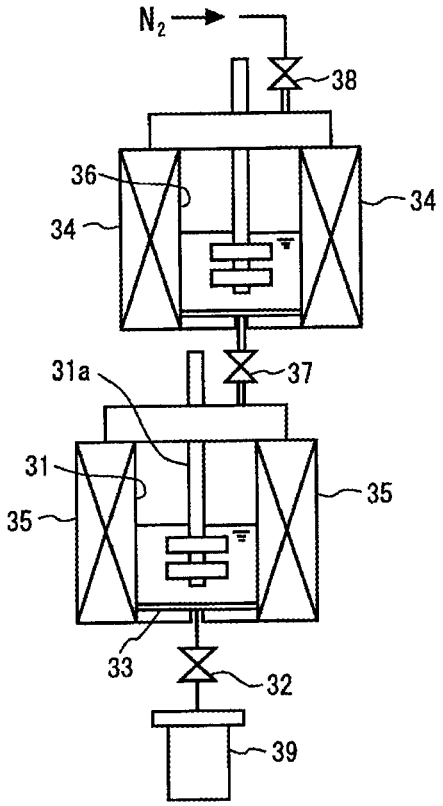
FIG. 4 is a view which illustrates a test apparatus for evaluating heating temperatures for an extraction solvent.

A coal and a solvent were mixed with each other to produce a pasty preliminary mixture having a coal concentration of 50%, by mass on a dry coal basis. This preliminary mixture was introduced, in a normal-temperature state, into the second autoclave vessel 36 illustrated in FIG. 4, which had been connected to an upper part of a first autoclave vessel 31 having a capacity of 500 cc. The preliminary mixture in the second autoclave vessel 36 was preheated to 250° C. with a heater 34 provided to the second autoclave vessel 36. Meanwhile, the same solvent as that used for producing the preliminary mixture was introduced as an extraction solvent into the first autoclave vessel 31 in an amount 2.6 times by mass the amount of the preliminary mixture, and the solvent in the first autoclave vessel 31 was heated to an extraction temperature (380° C.) or higher with a heater 35 provided to the first autoclave vessel 31, at an elevated pressure not less than the vapor pressure of the solvent. Nitrogen gas was introduced into the second autoclave vessel through a valve 38 provided to the second autoclave vessel 36, so that the second autoclave vessel 36 came to have a higher pressure than the first autoclave vessel 31. Thereafter, a valve 37 was opened to drop the preheated preliminary mixture within the second autoclave vessel 37 into the solvent, thereby elevating the temperature of the preliminary mixture in a moment. While stirring with a stirrer 31*a* provided to the first autoclave vessel 31, solvent-soluble components were extracted over an extraction period of 60 minutes. Thereafter, a valve 32 disposed in a pipeline connected to the bottom of the first autoclave vessel 31 was opened to filter the slurry in a hot state with a filter 33, and the filtrate was received with a receiver 39.

Comparative Example 1

The same treatment as in Example 1 was conducted, except that the preliminary mixture introduced into the second autoclave vessel 36 was not preheated, and that nitrogen gas was introduced into the second autoclave vessel 36 so as to result in a higher pressure than is the first autoclave vessel 31 and the valve 37 was opened to drop the preliminary mixture in the normal-temperature (25° C.) state into the extraction solvent.

Evaluation of Extraction Solvent Heating Temperature

With respect to Example 1 and Comparative Example 1, the heating temperature for the extraction solvent which was contained in the first autoclave vessel 31, before the preliminary mixture was dropped into the extraction solvent, was changed, and the preliminary mixture was dropped into this extraction solvent and temperature elevating was caused thereby and then the preliminary mixture was examined for the resultant temperature thereof.

The extraction-solvent heating temperatures, before the dropping of the preliminary mixture, which made the preliminary mixture have the temperature of the extraction temperature (380° C.) upon temperature elevating by dropping into the heated extraction solvent were 418° C. in Example 1 and 483° C. in Comparative Example 1. It can hence be seen that the extraction-solvent heating temperature for elevating the temperature of the preliminary mixture to an extraction temperature can be considerably lowered by preheating the preliminary mixture. In the case where the preliminary mixture is not preheated, the temperature of the extraction solvent must be highly elevated and the apparatus design pressure hence increases, resulting in an increase in equipment cost. Consequently, by preheating the preliminary mixture, the equipment cost can be reduced.

While the present mention has been described in detail and with reference to specific embodiments thereof, it will be apparent to one skilled in the art that various changes and modifications can be made therein without departing from the spirit and scope of the present invention.

The present application is based on a Japanese patent application filed on Sep. 30, 2014 (Application No. 2014-202092), the contents thereof being incorporated herein by reference.

INDUSTRIAL APPLICABILITY

As explained above, according to this process for ash-free coal production, the time period for extracting solvent-soluble components can be shortened at low cost and, hence, an ash-free coal can be highly efficiently obtained from coals at low cost.

DESCRIPTION OF THE REFERENCE NUMERALS AND SIGNS

1 Ash-free coal production apparatus
2 Preheating part
5 Extraction solvent heating part
4 Main heating part
5 Separation part
6 First vaporization part
7 Second vaporization part
8 Extraction solvent feed part
9 Preparation part
10 Preliminary-mixture heater
11 Preliminary-mixture compression transport pump
12 Extraction solvent tank
13 Extraction-solvent compression transport pump
14 Extraction tank
14*a* Stirrer
15 Main feed pipe
21 Ash-free coal production apparatus
22 Preheating part
23 Normal-pressure hopper
24 Coal heater
25 First valve
26 Second valve
27 Pressurization line
28 Gas discharge line
31 First autoclave vessel
31*a* Stirrer
32 Valve
33 Filter
34, 35 Heater
36 Second autoclave vessel
37, 38 Valve
39 Receiver
A Coal introduction point
B1 Coal preheating period
B2 Primary preheating period
B3 Secondary preheating period
C Rapid-temperature-elevating period
D Temperature holding period
Tn Normal Temperature
Tp1 Preheating temperature
Tp2 Primary preheating temperature
Te Extraction temperature
Ts1, Ts2 Unmixed-solvent temperature

The invention claimed is:

1. A process for producing an ash-free coal, comprising:
preheating a coal to provide a preheated coal;
heating an extraction solvent to a temperature higher than a temperature of the preheated coal to provide a heated extraction solvent;
mixing the preheated coal with the heated extraction solvent, thereby heating the preheated coal and providing a mixture of heated coal and extraction solvent;
separating a solution comprising the extraction solvent and a coal component dissolved therein from the mixture of heated coal and extraction solvent; and
separating the extraction solvent from the solution by a vaporization to obtain the ash-free coal.

2. The process for producing an ash-free coal according to claim 1, wherein the preheating comprises:

mixing a solvent for preheating with the coal to provide a preliminary mixture; and heating the preliminary mixture to provide said preheated coal.

3. The process for producing an ash-free coal according to claim 1, wherein the preheating comprises:

heating a solvent for preheating to provide a heated preheating solvent; and mixing the heated preheating solvent with the coal to provide said preheated coal.

4. The process for producing an ash-free coal according to claim 1, wherein the preheated coal has a temperature of 100° C. or more and 250° C. or less.

5. The process for producing an ash-free coal according to claim 1, wherein the heated extraction solvent has a temperature of 330° C. or more and 450° C. or less.

6. The process for producing an ash-free coal according to claim 1, wherein the preheating the coal is conducted at a heating rate of 5° C./min or more and 200° C./min or less.

7. The process for producing an ash-free coal according to claim 1, wherein a waste heat resulting from separating the extraction solvent is utilized in the preheating of the coal.

8. The process for producing an ash-free coal according to claim 1, wherein the mixing the preheated coal with the heated extraction solvent is conducted while keeping the heated extraction solvent in a turbulent-flow state.

9. The process for producing an ash-free coal according to claim 2, wherein the preheated coal has a temperature of 100° C. or more and 250° C. or less.

10. The process for producing an ash-free coal according to claim 3, wherein the preheated coal has a temperature of 100° C. or more and 250° C. or less.

11. The process for producing an ash-free coal according to claim 2, wherein the solvent for preheating is the same as the extraction solvent.

12. The process for producing an ash-free coal according to claim 3, wherein the solvent for preheating is the same as the extraction solvent.

13. The process for producing an ash-free coal according to claim 9, wherein the solvent for preheating is the same as the extraction solvent.

14. The process for producing an ash-free coal according to claim 10, wherein the solvent for preheating is the same as the extraction solvent.

15. The process for producing an ash-free coal according to claim wherein the preheated coal comprises said solvent for preheating and 40%-70% by mass of coal on a dry coal basis.

16. The process for producing an ash-free coal according to claim 3, wherein the preheated coal comprises said solvent for preheating and 40%-70% by mass of coal on a dry coal basis.

17. The process for producing an ash-free coal according to claim 2, wherein the solution comprises the extraction solvent and the solvent for preheating, said process comprising separating the extraction solvent and the solvent for preheating from the solution by a vaporization to obtain the ash-free coal.

18. The process for producing an ash-free coal according to claim 3, wherein the solution comprises the extraction solvent and the solvent for preheating, said process comprising separating the extraction solvent and the solvent for preheating from the solution by a vaporization to obtain the ash-free coal.

19. The process for producing an ash-free coal according to claim 1, wherein the separating the solution comprising the coal component dissolved therein from the mixture of the heated coal and the extraction solvent is conducted h gravitational settling.

20. The process for producing an ash-free coal according to claim 1, wherein the ash-free coal obtained has an ash content of 5% by mass or less.

* * * * *